US008835791B2

(12) United States Patent
Reuber et al.

(10) Patent No.: US 8,835,791 B2
(45) Date of Patent: Sep. 16, 2014

(54) PUSHROD ASSEMBLY FOR CIRCUIT BREAKER

(75) Inventors: Christian Reuber, Willich (DE); Philipp Masmeier, Düsseldorf (DE)

(73) Assignee: ABB Technology AG, Zurich (CH)

( * ) Notice: Subject to any disclaimer, the term of this patent is extended or adjusted under 35 U.S.C. 154(b) by 238 days.

(21) Appl. No.: 13/560,438

(22) Filed: Jul. 27, 2012

(65) Prior Publication Data

US 2013/0026016 A1 Jan. 31, 2013

(30) Foreign Application Priority Data

Jul. 27, 2011 (EP) ..... 11006149

(51) Int. Cl.
*H01H 3/46* (2006.01)
*H01H 33/662* (2006.01)
*H01H 33/666* (2006.01)

(52) U.S. Cl.
CPC ..... *H01H 33/666* (2013.01); *H01H 33/66261* (2013.01); *H01H 2033/6667* (2013.01)
USPC ..... 218/140; 218/154

(58) Field of Classification Search
USPC ..... 218/140, 154
See application file for complete search history.

(56) References Cited

U.S. PATENT DOCUMENTS

| | | | | |
|---|---|---|---|---|
| 3,076,080 | A * | 1/1963 | Ramrath | 218/107 |
| 4,500,762 | A * | 2/1985 | Yoshizumi | 218/143 |
| 6,373,015 | B1 * | 4/2002 | Marchand et al. | 218/139 |
| 6,657,150 | B1 | 12/2003 | Shea et al. | |
| 8,497,446 | B1 * | 7/2013 | Glaser | 218/136 |
| 2002/0044403 | A1 | 4/2002 | Takeuchi et al. | |
| 2004/0159635 | A1 | 8/2004 | Sato et al. | |
| 2012/0199557 | A1 * | 8/2012 | Yang | 218/118 |
| 2013/0264312 | A1 * | 10/2013 | Gentsch | 218/140 |
| 2014/0048514 | A1 * | 2/2014 | Balasubramanian et al. | 218/124 |

FOREIGN PATENT DOCUMENTS

| | | | |
|---|---|---|---|
| FR | 2 815 463 | A1 | 4/2002 |
| FR | 2 850 204 | A1 | 7/2004 |

OTHER PUBLICATIONS

European Search Report for Application No. 11006149.6.

* cited by examiner

*Primary Examiner* — Truc Nguyen
(74) *Attorney, Agent, or Firm* — Buchanan Ingersoll & Rooney PC

(57) ABSTRACT

A pushrod assembly for a circuit breaker having a pushrod with an insulating body, an insulating housing surrounding the push rod, a first insulating shield connected to the pushrod and a second insulating shield connected to the housing. The first insulating shield and the second insulating shield are arranged inside the housing such that an electrical path through a fluid inside the housing is longer than the distance of a first end and a second end of the push rod.

19 Claims, 5 Drawing Sheets

PUSHROD ASSEMBLY FOR CIRCUIT BREAKER

RELATED APPLICATION

This application claims priority under 35 U.S.C. §119 to European Patent Application No. 11006149.6 filed in Europe on Jul. 27, 2011, the entire content of which is hereby incorporated by reference in its entirety.

FIELD

The present disclosure relates to the field of medium and high voltage equipment, including, for example, a pushrod assembly for a circuit breaker.

BACKGROUND

Known circuit breakers can include two terminals that are pushed onto each other for generating an electrical contact and that are moved away from each other for disconnecting the electrical contact. Thus, a circuit breaker can include a drive that is mechanically interconnected over a push rod with one of the terminals that is adapted to transfer a movement of the drive onto the terminal.

As a rule, the end of the push rod connected with the terminal of the circuit breaker is also electrically connected to a medium or a higher voltage source. The other end of the push rod may be grounded. Since in this case the two ends of the push rod have to be insulated from each other, the push rod may have an insulating body and may be accommodated in a housing that is filled with a fluid, for example air, that additionally may provide insulation between the two ends of the push rod.

Therefore, the two ends of the push rod should have a certain minimal distance, such that the insulation specifications for the push rod assembly having the push rod and the housing are fulfilled. However, due to the minimal distance, the push rod assembly may have a minimal size that cannot be reduced any more.

Summarizing, an insulating push rod in air may be relatively long for fulfilling the electric specifications like providing the desired insulation between the two ends of the push rod. Thus, the length of the insulating push rod may avoid the reduction of the size of the circuit breaker.

SUMMARY

A pushrod assembly for a circuit breaker is disclosed, comprising: a pushrod with an insulating body; an insulating housing surrounding the push rod; a first insulating shield connected to the pushrod; and a second insulating shield connected to the housing, wherein the first insulating shield and the second insulating shield are arranged inside the housing such that during operation an electrical path to pass through a fluid inside the housing will be longer than a distance of a first end and a second end of the push rod.

A medium voltage circuit breaker is also disclosed, comprising: a vacuum switching chamber having two terminals; a pushrod assembly having an insulating body; an insulating housing surrounding the push rod; a first insulating shield connected to the pushrod; and a second insulating shield connected to the housing wherein the first insulating shield and the second insulating shield are arranged inside the housing such that during operation an electrical path to pass through a fluid inside the housing will be longer than a distance of a first end and a second end of the push rod, and wherein the pushrod assembly is connected for moving one of the two terminals of the vacuum switching chamber during operation.

BRIEF DESCRIPTION OF THE DRAWINGS

These and other aspects of the present disclosure will be apparent from and elucidated with reference to the embodiments described hereinafter. The subject matter of the invention will be explained in more detail in the following text with reference to exemplary embodiments which are illustrated in the attached drawings, wherein.

The reference symbols used in the drawings, and their meanings, are listed in summary form in the list of reference symbols. In principle, identical parts are provided with the same reference symbols in the figures.

DETAILED DESCRIPTION

Figure 1:
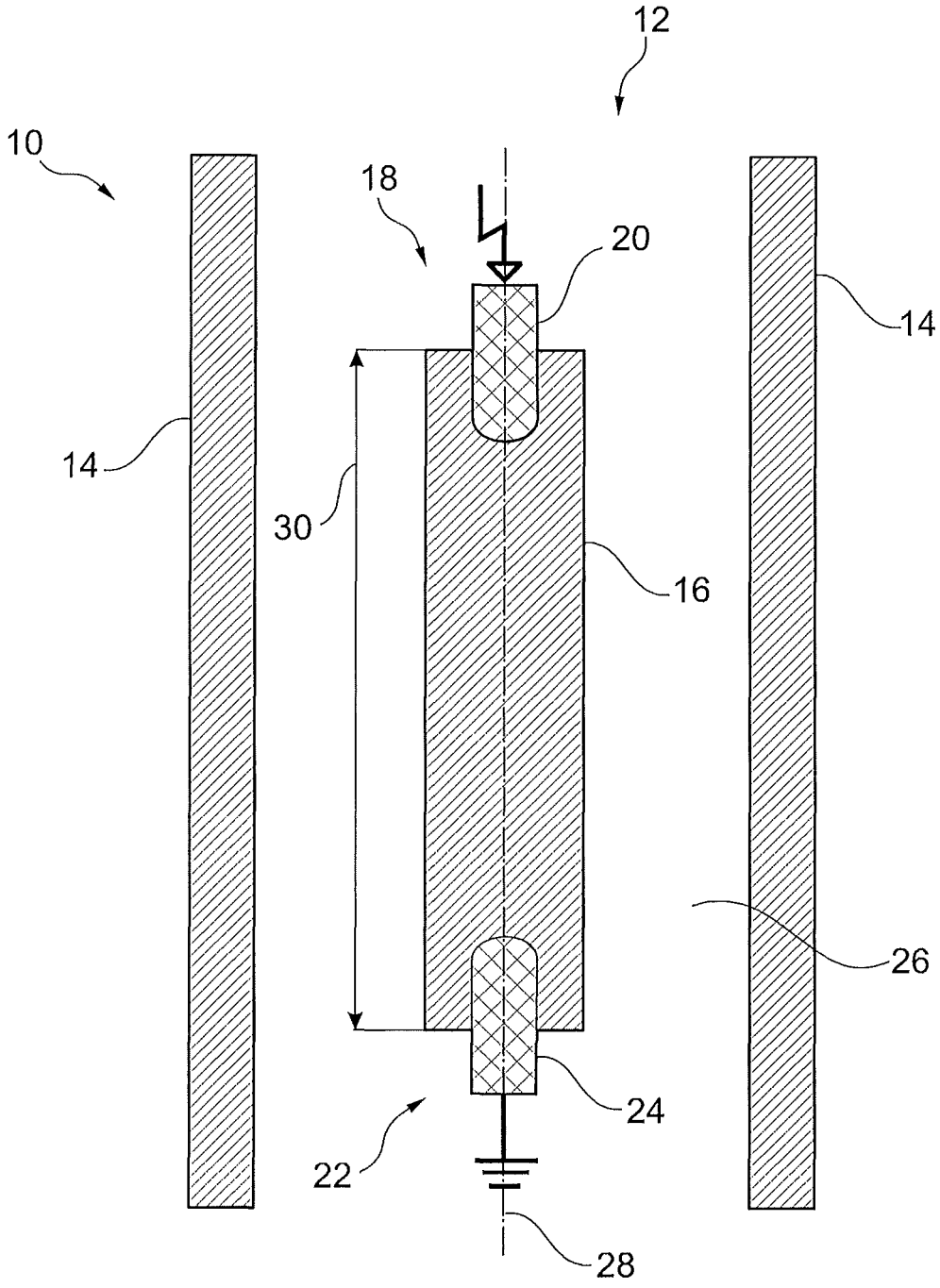
FIG. 1 shows a schematic cross-sectional view of an exemplary push rod assembly.

A push rod assembly is disclosed which can possess reduced size, thus reducing the amount of material and the costs of a circuit breaker.

Such a push rod assembly can be for an electrical circuit breaker. For example, the circuit breaker may be a medium voltage circuit breaker and/or a vacuum circuit breaker.

According to an exemplary embodiment, a push rod assembly comprises a push rod with an electrical insulating body. The push rod assembly may comprise an insulating housing that surrounds the push rod in a longitudinal direction of the push rod assembly. The push rod may be an elongated body that extends in the longitudinal direction of the push rod assembly. Furthermore, the push rod may be adapted to be moved within the housing in the longitudinal direction.

According to an exemplary embodiment, a push rod assembly comprises a first insulating shield that is mechanically connected to the push rod, and a second insulating shield that is mechanically connected to the housing. The first insulating shield and the second insulating shield are arranged inside the housing in such a way that an electrical short-circuit path through a fluid inside the housing is longer than the distance of a first end and a second end of the push rod. In other words, due to the insulating shields, it is not possible that a direct flashover occurs between the first end and the second end along the surface of the insulating body of the push rod, but the flashover would have to follow a longer path that is defined by the insulating walls of the insulating shields. The insulating shields may provide an additional insulating barrier between the two ends of the push rod. Because of this arrangement, the overall length of the push rod can be reduced. This may make it possible to design a smaller circuit breaker that uses less material and produces therefore lower costs.

According to an exemplary embodiment, the first end and the second end of the push rod are electrically conducting. It may be possible that electrical conducting terminals are attached to the ends of the insulating body of the push rod.

According to an exemplary embodiment, the first shield and the second shield form a labyrinth inside the housing. The two shields may be interlaced and may form a labyrinth with its walls that increases the length of the electrical path for a potential flashover in the fluid inside the housing.

According to an exemplary embodiment, the first shield, which is connected to the push rod, is formed like a cup with a sidewall surrounding the push rod in a longitudinal direction of the push rod, and a bottom wall protruding from the push rod and interconnecting the push rod with the sidewall. For example, the sidewall of the first shield may be formed like a cylinder, and the bottom wall may be formed like a disc. In such a way, an insulating barrier which provides walls of the labyrinth may be provided inside the housing.

According to an exemplary embodiment, the first end of the push rod is connectable to a medium or high voltage source. For example, the electrical conducting terminal at the first end of the push rod is connected over a flexible conductor to a rigid conductor which provides the voltage that is to be switched by the circuit breaker.

According to an exemplary embodiment, the second end of the push rod may be adapted to be grounded. For example, the terminal at the end of the push rod may be connected to a conductor of the circuit breaker that is grounded.

According to an exemplary embodiment, the cup of the first shield may be opened towards the first end or may be opened towards the second end. This may depend on further constructional constraints, for example the region to which the first shield is attached.

According to an exemplary embodiment, the first shield, and for example, the bottom wall of the cup, is connected to the push rod in a middle region of the push rod. The middle region of the push rod may be a region between the first end and the second end of the push rod. According to an exemplary embodiment, the first shield is connected to the push rod in an end region of the push rod. The end region of the push rod may be at the first end or the second end of the push rod, and may be the region at which an electrical conducting terminal is attached to the push rod.

According to an exemplary embodiment, the second shield is formed like a collar with a sidewall surrounding the push rod, and an end wall protruding from the housing and interconnecting the housing and the sidewall. For example, the sidewall of the second shield may be a cylinder, and the end wall of the second shield may be a disc. In such a way, also the second shield may provide an insulating barrier with insulating walls for forming the labyrinth inside the housing.

According to an exemplary embodiment, the sidewall of the second shield protrudes into the first shield formed like a cup. In such a way, the sidewalls and end walls of the collar and the cup are forming a labyrinth inside the housing that may lengthen the electrical path between the two ends of the push rod by nearly the longitudinal extension of the sidewalls. A flashover from the first end of the terminal to the second end would have to pass the sidewall of the collar attached to the housing, then turn, for example, by 180°, and would have to pass the sidewall of the cup attached to the push rod, then would have to turn by, for example, 180°, and would have to pass the sidewall of the cup again, before it may reach the second terminal attached to the second end of the push rod.

According to an exemplary embodiment, the push rod assembly comprises a connector for electrically connecting the first end of the push rod with a voltage source. Such a connector may have an insulating coverage. This insulating coverage may be integrated in the second shield attached to the housing of the push rod assembly. In this way, an effective isolation for the connector and the push rod may be provided with one component that may be manufactured from one material. For example, the insulating coverage of the connector in the second shield may be manufactured in one piece.

A circuit breaker, is also disclosed, such as a medium voltage circuit breaker and/or a vacuum circuit breaker.

According to an exemplary embodiment, the circuit breaker can comprise a (for example vacuum) switching chamber with two terminals and a push rod assembly as described in the above and in the following. The push rod assembly is adapted to move one of the terminals of the switching chamber. Due to the reduced size of the push rod assembly, also the size of the circuit breaker may be reduced.

FIG. 1 shows an exemplary push rod assembly 10 comprising a push rod 12 in a housing 14. The movable push rod 12 comprises an insulating body 16 or insulating part 16, a first end 18, to which a first terminal 20 is attached, and a second end 22, to which a second terminal 24 is attached. In the case shown in FIG. 1, the terminal 24 is grounded, while the terminal 20 can be connected to a medium or a high voltage source. The push rod 12 is located within the insulating housing 14, that may be adapted to seal its interior from its outside. The space 26 between the push rod 12 and the housing 14 may be filled with a gas 26 or a liquid 26, whose insulating properties are inferior to those of the insulating body 16. For example, the space 26 may be filled with air.

Figure 6:
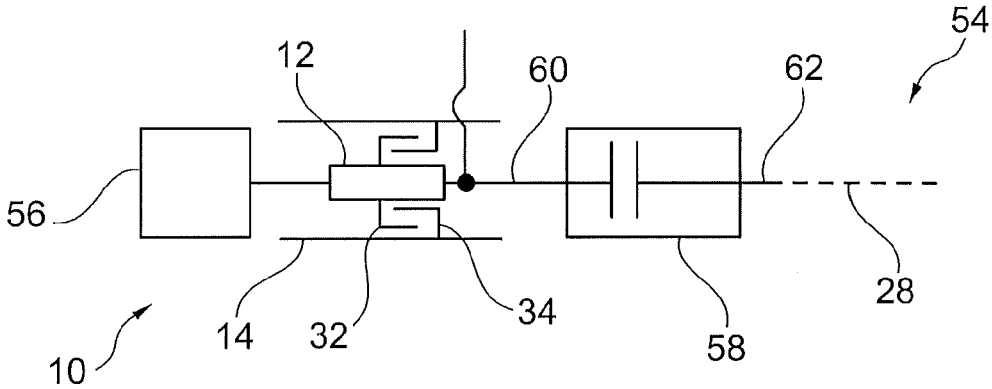
FIG. 6 shows a circuit breaker according to an exemplary embodiment.

The push rod 12 may be moved (for example up and down) along a longitudinal axis 28 to connect and disconnect a movable electrical contact or terminal to a non-movable electrical contact or terminal of a circuit breaker (analog FIG. 6). The design of the push rod assembly 10 shown in FIG. 1 results in a certain minimal length 30 of the insulating body 16 to fulfill the dielectric requirements for insulating the first terminal 20 from the second terminal 24. The minimal length 30 may be adverse for the design of a circuit breaker, following the tendency to reduce the size, the required material and the costs of switch gear components.

Figure 2:
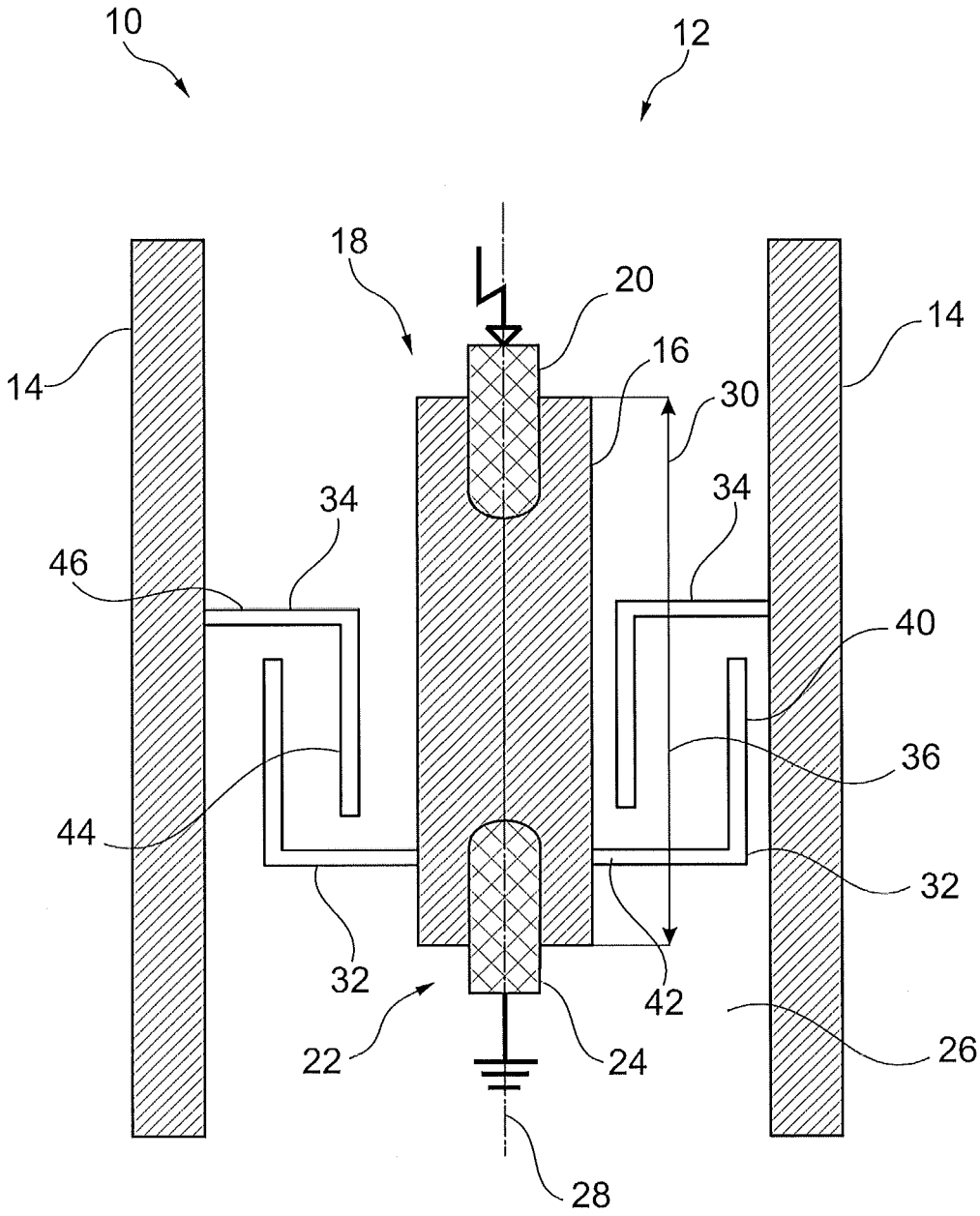
FIG. 2 shows a schematic cross-sectional view of a push rod assembly according to an exemplary embodiment.

FIG. 2 shows an exemplary push rod assembly 10 with a first insulating shield 32 that is connected to the push rod 12, and a second insulating shield 34 that is connected to the housing 14. The two shields 32, 34 are interlaced forming a labyrinth in the space 26 inside the housing 14.

A flashover through the space 26 between the terminal 20, or further parts that are electrically connected to the terminal 20, and the terminal 24, or further parts that are electrically connected to the terminal 24, would have to pass the increased distance of the electrical path through the labyrinth 36. As the insulating properties of the insulating body 16 and of the insulating shields 32, 34 are superior to those of the material inside the space 26, the minimal length 30 between the terminals 20, 24 of the push rod 12 may therefore be reduced without reducing the dielectric performance of the push rod 12 and the medium 26 inside the housing 14.

The shield 32 can be formed like a cup with a cylindrical sidewall 40 that extends in the longitudinal direction 28 and that surrounds the push rod 12. The first shield 32 comprises further a bottom wall 42 that is shaped like a disc and extends in a direction orthogonal to the longitudinal direction 28 and that interconnects the push rod 12 with the sidewall 40.

The second shield 34 can be formed like a collar with a cylindrical sidewall 44 extending in the longitudinal direction 28, surrounding the push rod 12 and protruding into the sidewall 40 of the first shield 32. The sidewall 44 of the second shield 34 is interconnected with the housing 14 over an end wall 46 that protrudes from the housing 14 in an orthogonal direction with respect to the longitudinal direction 28. The radial distance from the sidewall 44 of the second shield 34 is smaller than the radial distance of the sidewall 40 of the first shield 32 with respect to the longitudinal axis 28.

In the exemplary push rod assembly 10 shown in FIG. 2, the bottom wall 42 of the first shield 32 is connected to the push rod 12 in the region of the second end 22 of the push rod. Further, the cup of the first shield 32 is opened towards the first end 18 of the push rod 12.

Figure 3:
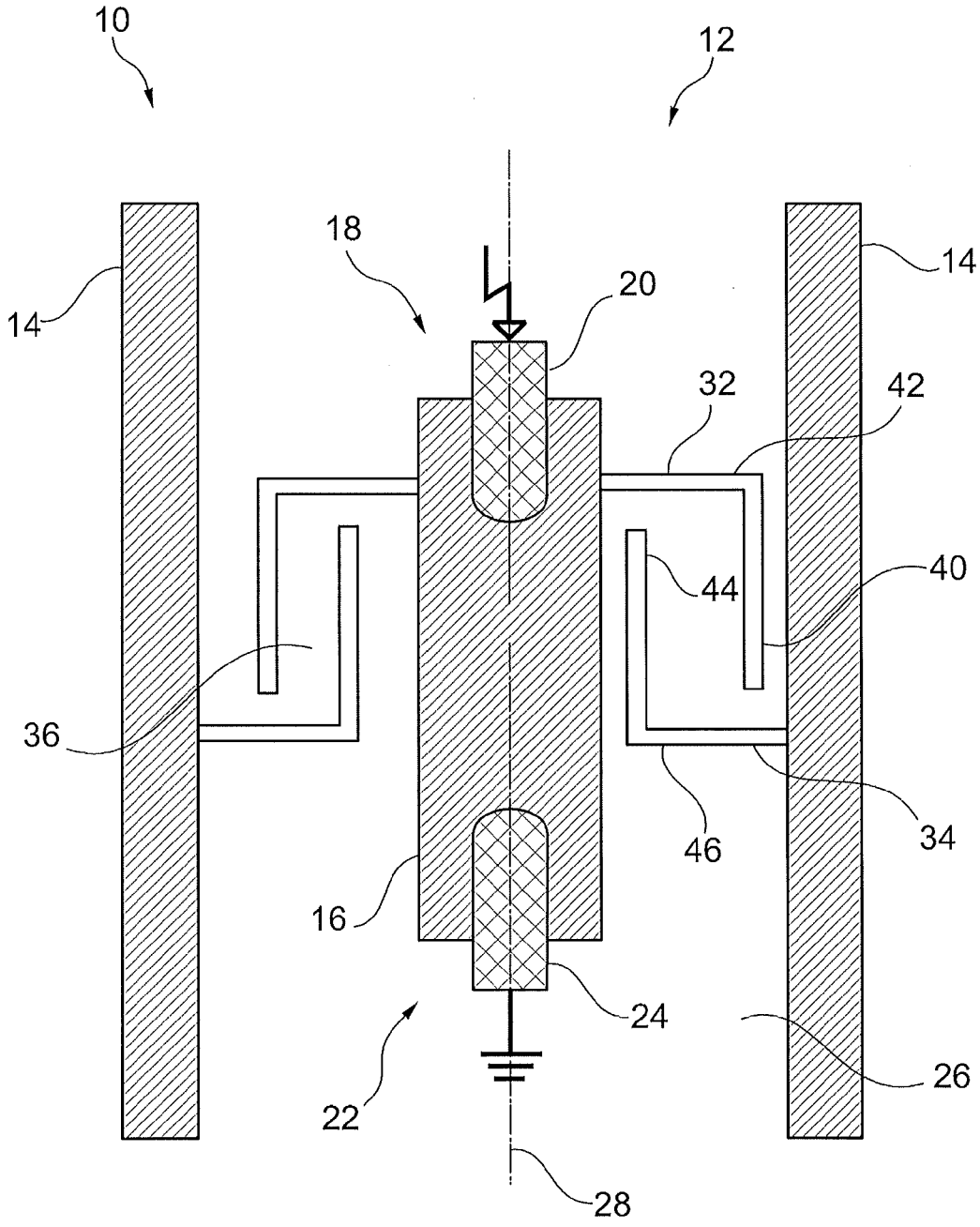
FIG. 3 shows a schematic cross-sectional view of a push rod assembly according to an exemplary embodiment.

In FIG. 3, an exemplary push rod assembly 10 is shown. In FIG. 3, the first shield 32 is connected to the first end 18 of the push rod 12. Furthermore, similar to FIG. 2, the sidewall 44 of the second shield 34 protrudes into the sidewall 40 of the first shield 32.

The arrangement shown in FIGS. 2 and 3 may depend on design constraints on the push rod assembly 10. For example, it may be desirable, that the cup of the first shield 32 opens into the direction of the second end 22 of the push rod, such that no liquid may be gathered by the first shield 32, when the push rod assembly 10 is arranged like shown in FIG. 3.

Figure 4:
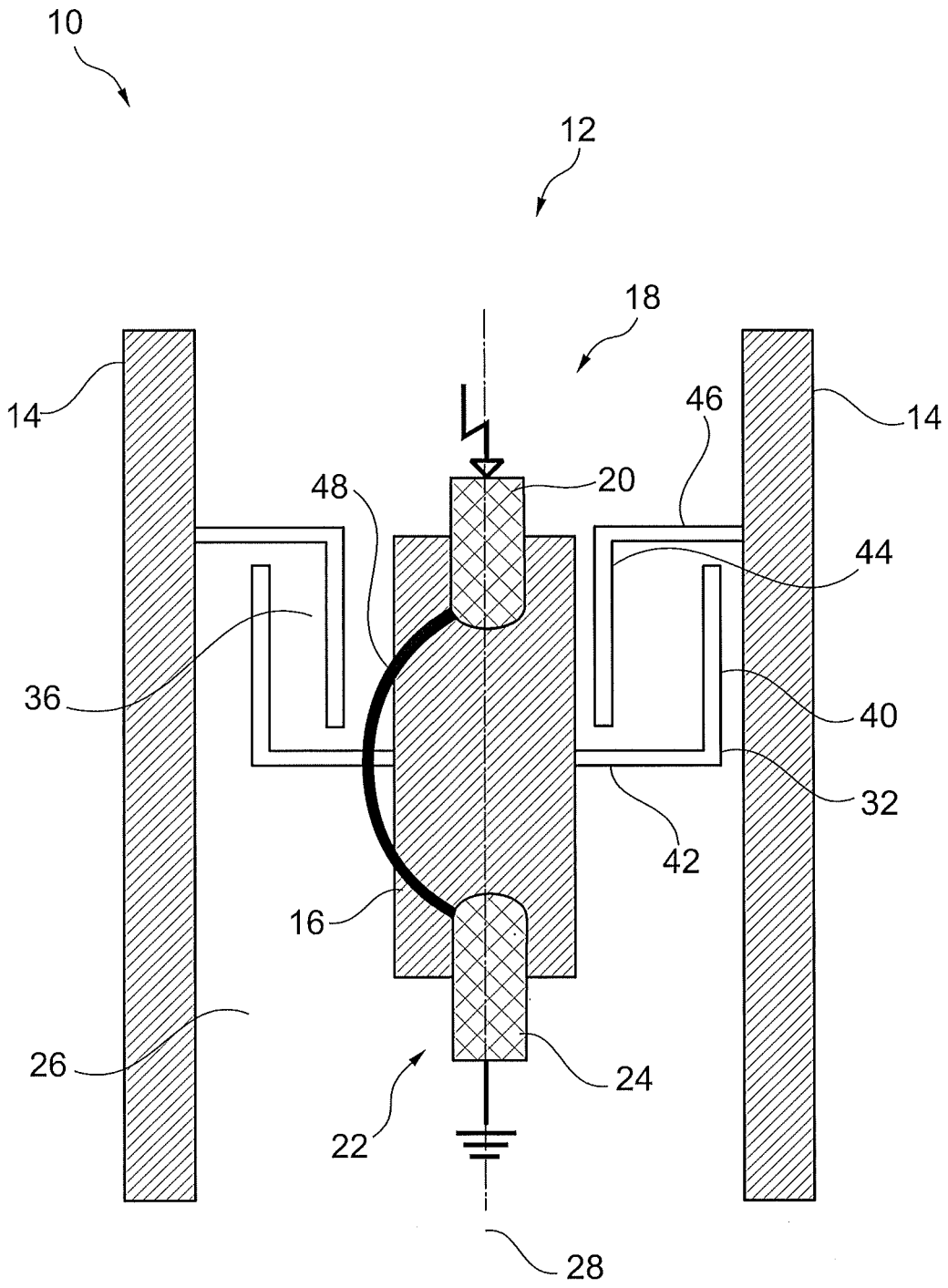
FIG. 4 shows a schematic cross-sectional view of a push rod assembly according to an exemplary embodiment.

FIG. 4 shows an exemplary embodiment of a push rod assembly 10 in which the first shield 32, and in particular the bottom wall 42, is connected to the push rod 12 in a middle region of the push rod 12. In case a key path 48 for a flashover goes from the embedded end of terminal 20 through the insulating body 16, then through the space 26, and then again through the insulating body 16, and finally to the other terminal 24, it may be advantageous to connect the shield 32 to the push rod 12 at a location between the terminals 20, 24 (e.g., in a middle region of the push rod 12). In such a way, the flashover that follows the critical path 48 would have to cross an additional insulating barrier, for example the bottom wall 42 of the first shield 32.

Figure 5:
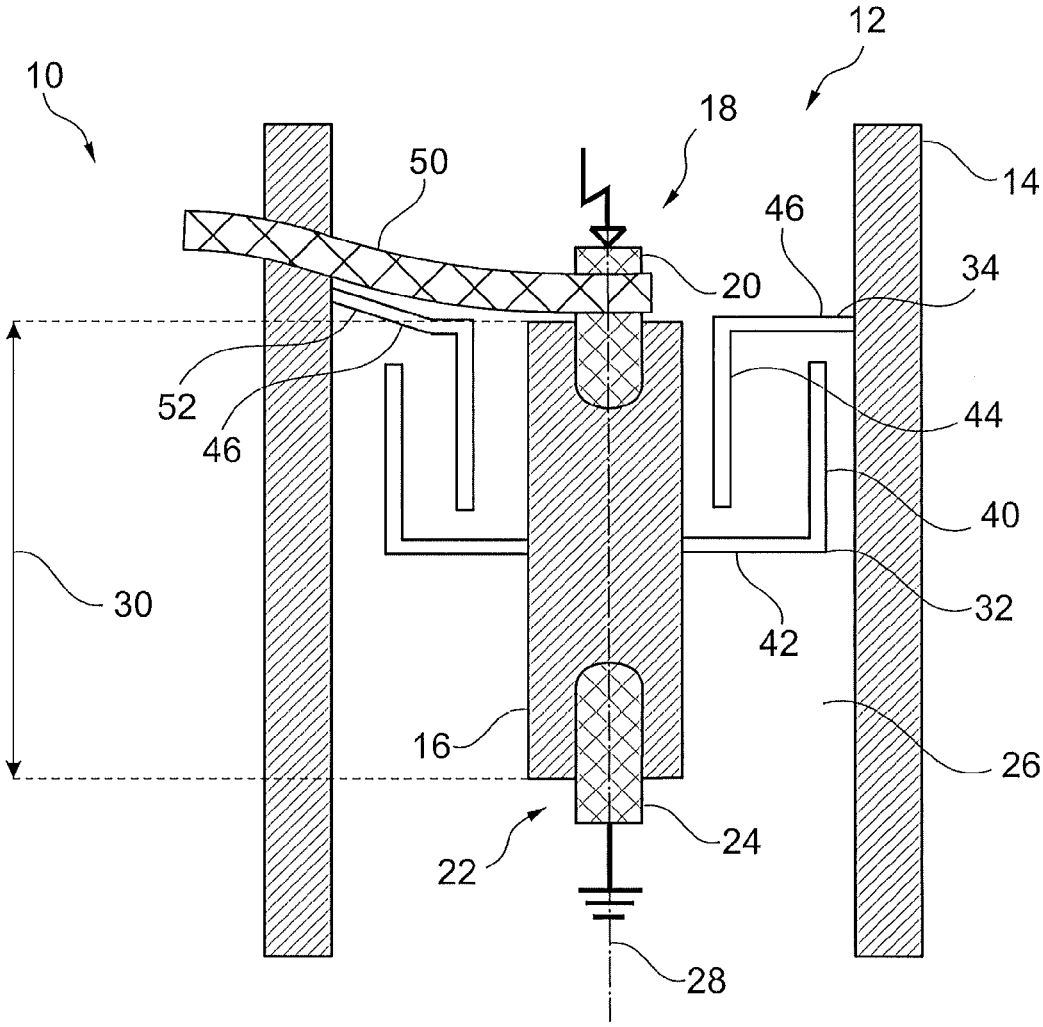
FIG. 5 shows a schematic cross-sectional view of a push rod assembly according to an exemplary embodiment.

FIG. 5 shows an exemplary embodiment of a push rod assembly 10 which comprises a flexible connector 50. The flexible connector 50 enters the housing 14 from the side (with respect to the longitudinal axis 28) and is electrically connected to the terminal 20. In general, in a switch or circuit breaker, the movable terminal 20 has to be electrically connected to the non-movable environment, for example using sliding contacts or a flexible connector 50. It may be that the flexible connector 50 or its related components (like screws) are the critical starting or ending point of a flashover to the space 26 towards the first items at the terminal 24. Therefore, it can be advantageous for obtaining a minimal length 30 of the push rod 12 by integrating an insulating coverage 52 of the connector 50 and its related components into the adjacent shield 34.

As shown in FIG. 5, the end wall 46 of the shield 34 provides a part of the insulating coverage 52 of the connector 50.

Vice versa, it may also be that earth items that are electrically connected to the terminal 24, like drive parts, bolts, screws, shield metal parts and the like, are a key (e.g., critical) starting or ending point of a flashover through the space 26 towards the items at the terminal 20 which are connected to a medium or a high voltage source. Therefore, it can be advantageous for obtaining a minimum length 30 of the push rod 12 by integrating an insulating coverage of the earth components into the adjacent shield 42.

FIG. 6 schematically shows an exemplary circuit breaker 54 comprising a drive 56 that is mechanically connected over a push rod assembly 10 with a terminal 60 of a vacuum chamber 58. The push rod 12 may be moved (for example to the left and to the right) along the axis 28 to connect and disconnect the movable electrical contact 60 or terminal 60 to a non-movable electrical contact 62 or terminal 62. The arrangement 10 may be used in medium or high voltage switches 54 or circuit breakers 54 to transfer the force and the motion of the drive 56, which may be mechanically connected to the grounded terminal 24, to the switching element 60, which may be mechanically connected to the terminal 20.

While exemplary embodiments have been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 pushrod assembly
12 pushrod
14 housing
16 insulating body
18 first end
20 first terminal
22 second end
24 second terminal
26 space
28 longitudinal axis
30 minimal length
32 first shield
34 second shield
36 labyrinth
40 side wall of first shield
42 bottom wall of first shield
44 side wall of second shield
46 end wall of second shield
48 critical path
50 flexible connector
52 insulating coverage
54 circuit breaker
56 drive
58 vacuum chamber
60, 62 terminal

The invention claimed is:

1. A pushrod assembly for a circuit breaker, comprising:
a pushrod with an insulating body;
an insulating housing surrounding the push rod;
a first insulating shield connected to the pushrod; and
a second insulating shield connected to the housing, wherein the first insulating shield and the second insulating shield are arranged inside the housing such that during operation an electrical path to pass through a fluid inside the housing will be longer than a distance of a first end and a second end of the push rod.

2. The pushrod assembly of claim 1, wherein the first shield and the second shield form a labyrinth inside the housing.

3. The pushrod assembly of claim 1, wherein the first shield is formed as a cup with a side wall surrounding the push rod in a longitudinal direction of the pushrod and a bottom wall protruding from the pushrod and interconnecting the pushrod with the side wall.

4. The pushrod assembly of claim 3, wherein the cup is opened towards the first end.

5. The pushrod assembly of claim 3, wherein the cup is opened towards the second end.

6. The pushrod assembly of claim 1, wherein the first shield is connected to the pushrod in a middle region of the push rod, or wherein the first shield is connected to the pushrod in an end region of the pushrod.

7. The pushrod assembly of claim 1, wherein the second shield is formed as a collar with a side wall surrounding the pushrod and an end wall protruding from the housing and interconnecting the housing and the side wall.

8. The pushrod assembly of claim 7, wherein the side wall of the collar protrudes into the first shield formed as a cup.

9. The pushrod assembly of claim 1, comprising:

a connector for electrically connecting the first end of the pushrod with a voltage source, wherein the connector has an insulating coverage, and wherein the second shield is integrated with the insulating coverage.

10. A medium voltage circuit breaker, comprising:

a vacuum switching chamber having two terminals;

a pushrod assembly having an insulating body;

an insulating housing surrounding the push rod;

a first insulating shield connected to the pushrod; and a second insulating shield connected to the housing wherein the first insulating shield and the second insulating shield are arranged inside the housing such that during operation an electrical path to pass through a fluid inside the housing will be longer than a distance of a first end and a second end of the push rod, and wherein the pushrod assembly is connected for moving one of the two terminals of the vacuum switching chamber during operation.

11. The pushrod assembly of claim 2, wherein the first shield is formed as a cup with a side wall surrounding the push rod in a longitudinal direction of the pushrod and a bottom wall protruding from the pushrod and interconnecting the pushrod with the side wall.

12. The pushrod assembly of claim 11, wherein the cup is opened towards the first end.

13. The pushrod assembly of claim 11, wherein the cup is opened towards the second end.

14. The pushrod assembly of claim 12, wherein the first shield is connected to the pushrod in a middle region of the push rod, or wherein the first shield is connected to the pushrod in an end region of the pushrod.

15. The pushrod assembly of claim 13, wherein the first shield is connected to the pushrod in a middle region of the push rod, or wherein the first shield is connected to the pushrod in an end region of the pushrod.

16. The pushrod assembly of claim 14, wherein the second shield is formed as a collar with a side wall surrounding the pushrod and an end wall protruding from the housing and interconnecting the housing and the side wall.

17. The pushrod assembly of claim 15, wherein the second shield is formed as a collar with a side wall surrounding the pushrod and an end wall protruding from the housing and interconnecting the housing and the side wall.

18. The pushrod assembly of claim 16, comprising:

a connector for electrically connecting the first end of the pushrod with a voltage source, wherein the connector has an insulating coverage, and wherein the second shield is integrated with the insulating coverage.

19. The pushrod assembly of claim 17, comprising:

a connector for electrically connecting the first end of the pushrod with a voltage source, wherein the connector has an insulating coverage, and wherein the second shield is integrated with the insulating coverage.

* * * * *